US007425801B2

(12) United States Patent
Ozaki

(10) Patent No.: US 7,425,801 B2
(45) Date of Patent: Sep. 16, 2008

(54) LED DRIVING DEVICE FOR MULTIPLE COLOR LED DISPLAYS

(75) Inventor: Yutaka Ozaki, Tsuchiura (JP)

(73) Assignee: Hunet Display Technology Inc., Tokyo (JP)

( * ) Notice: Subject to any disclaimer, the term of this patent is extended or adjusted under 35 U.S.C. 154(b) by 253 days.

(21) Appl. No.: 10/532,216

(22) PCT Filed: Mar. 26, 2004

(86) PCT No.: PCT/JP2004/004313

§ 371 (c)(1),
(2), (4) Date: Aug. 31, 2005

(87) PCT Pub. No.: WO2004/090997

PCT Pub. Date: Oct. 21, 2004

(65) Prior Publication Data

US 2006/0103612 A1 May 18, 2006

(30) Foreign Application Priority Data

Apr. 1, 2003 (JP) ..... 2003-098486
Apr. 1, 2003 (JP) ..... 2003-098487
Apr. 1, 2003 (JP) ..... 2003-098489

(51) Int. Cl.
*G05F 1/00* (2006.01)

(52) U.S. Cl. ..... 315/291; 315/169.1; 315/169.2; 345/77; 345/82; 345/83

(58) Field of Classification Search ..... 345/39, 345/44, 77, 82, 83, 102; 315/169.1–169.3, 315/291, 312; 250/205; 349/50, 62
See application file for complete search history.

(56) References Cited

U.S. PATENT DOCUMENTS 5,724,062 A * 3/1998 Hunter ..... 345/102
5,808,592 A 9/1998 Mizutani et al. ..... 345/83
6,069,676 A * 5/2000 Yuyama ..... 349/62
6,342,897 B1 1/2002 Wen
6,674,060 B2 * 1/2004 Antila ..... 250/205
6,747,617 B1 6/2004 Kawashima
7,088,334 B2 * 8/2006 Adachi et al. ..... 345/102
2003/0016198 A1 1/2003 Nagai et al. ..... 345/83
2006/0152468 A1 * 7/2006 Ozaki ..... 345/102

FOREIGN PATENT DOCUMENTS

JP 3016636 7/1995
JP 7-288342 10/1995

(Continued)

*Primary Examiner*—Haissa Philogene
(74) *Attorney, Agent, or Firm*—Nath Law Group; Jerald L. Meyer; Stan N. Protigal

(57) ABSTRACT

Driving voltages of an LED of each color are stored in applied voltage storage register 11, 12 or 13, and the LED of each color is driven with independent driving voltage, whereby current consumption is reduced. Further, data in applied voltage storage registers 11, 12 and 13 is made rewritable via storage value setting bus 14, and when there are fluctuations in minimum emission voltage in actually mounted LEDs due to individual differences, voltages to store in the applied voltage storage registers 11, 12 and 13 can be changed as appropriate corresponding to the fluctuations.

7 Claims, 9 Drawing Sheets

FOREIGN PATENT DOCUMENTS

| | | |
|---|---|---|
| JP | 09-081211 | 3/1997 |
| JP | 200-241811 | 9/2000 |
| JP | 2001-051651 | 2/2001 |
| JP | 2001-290458 | 10/2001 |
| JP | 2003-058125 | 2/2003 |
| KR | 2002-0073507 | 9/2002 |
| KR | 2003-0001848 | 1/2003 |
| TW | 480879 | 3/2002 |

* cited by examiner

| | MINIMUM VALUE | STANDARD VALUE | MAXIMUM VALUE |
|---|---|---|---|
| RED LED | 1.75 | 2.2 | 2.45 |
| GREEN LED | 2.9 | 3.3 | 3.9 |
| BLUE LED | 2.9 | 3.4 | 3.9 |

UNIT :V

FIG.2

LED DRIVING DEVICE FOR MULTIPLE COLOR LED DISPLAYS

TECHNICAL FIELD

The present invention relates to an LED driving device and LED driving method for lighting LEDs (Light Emitting Diode) of three primary colors, R, G, B, to perform color display, particularly.

BACKGROUND ART

Conventionally, as a liquid crystal display device using LEDs of three primary colors, R(red)-G(green)-B(blue), liquid crystal display devices of field sequential system (hereinafter, referred to as an FS system) have been implemented, for example, as disclosed in JP 2000-241811. In the FS-system liquid crystal display device, three-color LEDs are provided on the back surface of a liquid crystal shutter, each of the LEDs is sequentially lighted at high speed while opening and closing the liquid crystal shutter in each pixel position to be synchronized with lighting of the LEDs, and thereby, a desired color can be displayed in each pixel position.

For example, in the case of displaying red, the liquid crystal shutter is opened during a period of time a red LED emits light, and then closed during a period of time a green LED emits light and a period of time a blue LED emits light. The case of displaying green or blue is the same, and the liquid crystal shutter is opened only during a period of time the LED of desired color emits light, and closed during periods of time the other LEDs emit light.

Further, opening the liquid crystal shutter for periods during which red and green LEDs emit light enables Y (Yellow) to be displayed, opening the liquid crystal shutter for periods during which red and blue LEDs emit light enables M (Magenta) to be displayed, opening the liquid crystal shutter for periods during which green and blue LEDs emit light enables C (Cyan) to be displayed, and opening the liquid crystal shutter for all the periods during which red, green and blue LEDs emit light enables W (White) to be displayed.

In such an FS system, by lighting three-color LEDs sequentially at speed higher than human visual reaction speed, color display is implemented by additive color process. Then, adopting the FS system eliminates the need of color filter, and enables sharpened color display to be performed.

With the widespread use of portable devices such as cellular telephones in recent years, it has been desired to achieve display devices capable of being mounted on the portable devices and performing color display with high definition. The liquid crystal display device using three-color LEDs as described above does not need a color filter, and therefore, enables display with high luminance.

However, in the liquid crystal display device using three-color LEDs, a large number of LED chips are generally provided to constitute an LED of each color, the voltage is applied to the large number of LED chips to light the LED of each color, and therefore, power is consumed in the large number of LED chips.

Meanwhile, there are limitations in capacity of a battery in a portable device, and the less current consumption in a display device, the better. Obviously, reduction in current consumption is required of not only portable devices but also all the electric devices.

Further, LEDs have fluctuations in characteristics, and it is required to perform display with uniformity, while absorbing the fluctuations. In order to absorbing the fluctuations, methods have conventionally been used such that a fine adjustment is made to a resistance value corresponding to the LED of each color, but there is a problem that such operation requires significantly complicated effort.

DISCLOSURE OF INVENTION

It is a principal object of the present invention to provide an LED driving device and LED driving method enabling efficiently reduced current consumption, and further provide an LED driving device and LED driving method enabling fluctuations in characteristics of each LED to be absorbed.

The object is achieved by beforehand measuring a minimum driving voltage to obtain a desired luminance on an LED of each of colors, red, green and blue, storing the minimum driving voltage in a storage section for the LED of each of colors, and applying the driving voltage of the stored value to the LED of each of colors.

Further, the object is achieved by performing PWM control on the LED of each of colors with a PWM signal having a different duty ratio varying with the LED of each of colors in such a state that the minimum driving voltage is applied to the LED of each of colors on a color basis.

BRIEF DESCRIPTION OF DRAWINGS

FIG. 2 is a diagram showing minimum voltage values required to obtain a desired luminance in an LED of each color;

BEST MODE FOR CARRYING OUT THE INVENTION

The inventor of the present invention noticed that an applied voltage required to light an LED of each of colors, R, G, B, in desired luminance is not the same on all the LEDs, and varies with the LED of each color, and has reached the present invention.

It is gist of the present invention beforehand measuring a minimum driving voltage to obtain a desired luminance on an LED of each of colors, red, green and blue, storing the minimum driving voltage in a storage section for the LED of each of colors, and applying the driving voltage of the stored value to the LED of each of colors.

Embodiments of the present invention will specifically be described below with reference to drawings.

Embodiment 1

Figure 1:
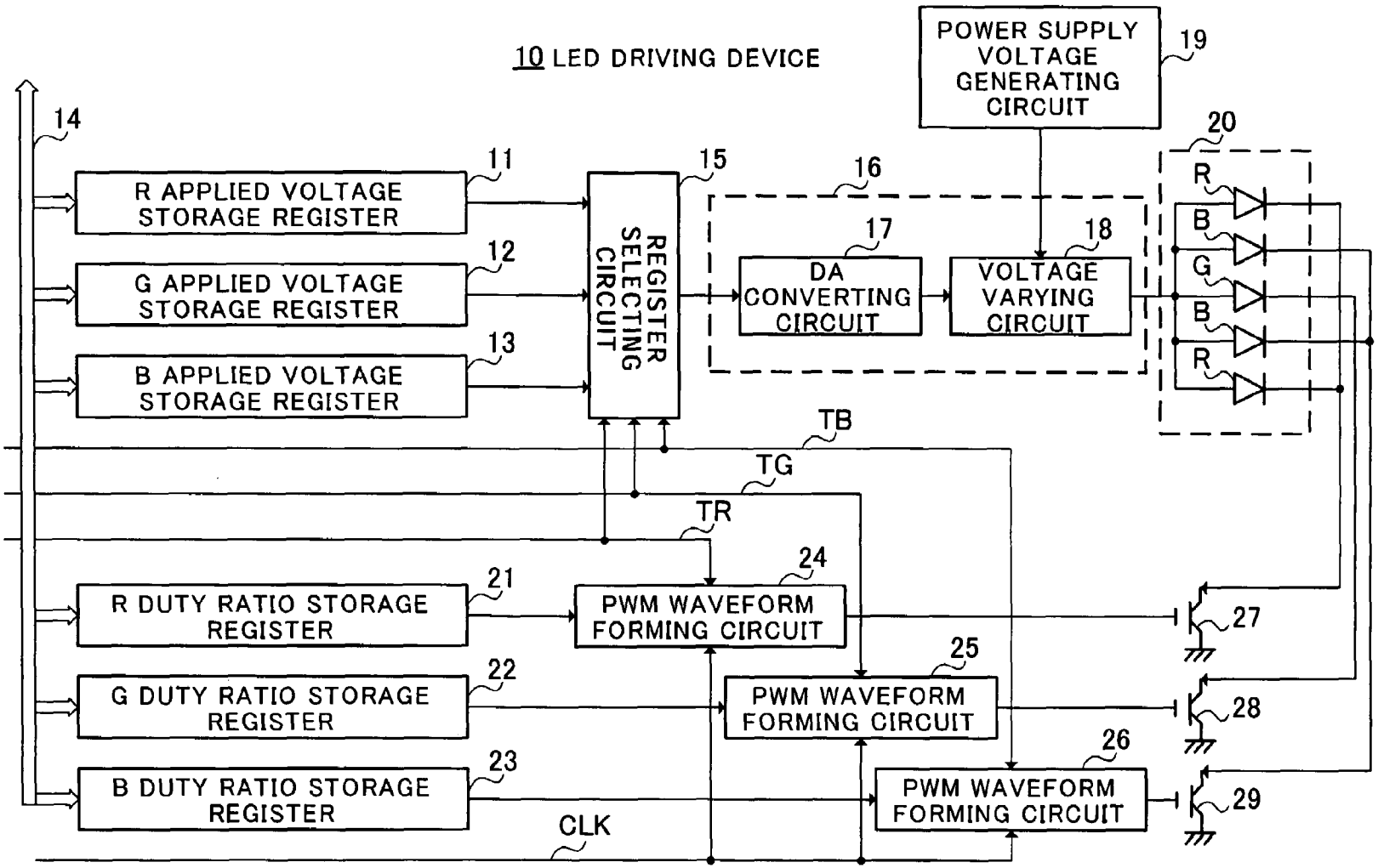
FIG. 1 is a block diagram illustrating a configuration of an LED driving device of Embodiment 1 of the present invention.

In FIG. 1, "10" denotes an LED driving device according to Embodiment 1 of the present invention, as a whole. LED driving device 10 is provided in a liquid crystal display device, and drives LEDs of three colors, R, G and B, provided on the back face of a liquid crystal panel. Further, this embodiment describes the case of applying the LED driving device of the present invention to a liquid crystal display device of field sequential system, as an example.

LED driving device 10 has R (red) applied voltage storage register 11, G (green) applied voltage storage register 12 and B (blue) applied voltage storage register 13. Each of the registers 11, 12 and 13 stores voltage values to apply to the R, G, or B LED, respectively. Each of the registers 11, 12 and 13 is connected to storage value setting bus 14, and applied voltage values for the LED of each color are stored in each of the registers 11, 12 and 13 via storage value setting bus 14 when a product of LED driving device 10 is shipped.

The applied voltage value for the LED of each color output from each of the registers 11, 12 and 13 is input to register selecting circuit 15. Register selecting circuit 15 further receives as its inputs a red-LED emission timing signal TR, green-LED emission timing signal TG, and blue-LED emission timing signal TB, and based on the emission timing signal, selects either the applied voltage value for R, G or B to output.

For example, when the red-LED emission timing signal TR has a logic value of "1", and each of the green-LED emission timing signal TG and blue-LED emission timing signal TB has a logic value of "0", the circuit 15 selects the applied voltage value stored in R applied voltage storage register 11. In the case of this embodiment, since display is performed in the field sequential system, for example, when the field frequency is assumed to be 65 Hz, the LED of each color is lighted sequentially with the three-time frequency, 195 Hz. In other words, register selecting circuit 15 selects and outputs voltage values stored in R applied voltage storage register 11, G applied voltage storage register 12 and B applied voltage storage register 13 in turn at intervals of about 5 mS.

The applied voltage value selected by register selecting circuit 15 is converted into an analog value by digital analog (DA) converting circuit 17 in applied voltage forming circuit 16, and then output to voltage varying circuit 18. Voltage varying section 18 converts a voltage generated in power supply voltage generating circuit 19 into a voltage corresponding to an analog value input from digital analog converting circuit 17, and supplies the voltage to LED unit 20.

Thus, LED driving device 10 has the registers 11, 12 and 13 that store voltage values to apply to LEDs of respective colors, and converts a voltage generated in power supply voltage generating circuit 19 into a value stored in the register 11, 12 or 13 to supply to a corresponding one of the LEDs. By this means, it is possible to reduce power consumption as compared with the case of applying the same voltage to the LED of each color.

FIG. 2 shows minimum applied voltage values (hereinafter referred to as minimum emission voltages) required to obtain a desired luminance in an LED of each color. As can be seen from the figure, minimum emission voltages of the green LED and blue LED are almost the same, while minimum emission voltages of the red LED are lower than those minimum emission voltages.

Applied voltage storage registers 11, 12 and 13 of LED driving device 10 store minimum emission voltage values of the LEDs of respective colors. Among the stored minimum emission voltage values, values of the red LED are actually lower than values of the green LED and blue LED. In other words, it is possible to apply a minimum voltage required for each of the LEDs, and it is thus possible to reduce current consumption.

Further, as can be seen from FIG. 2, even in the LED of each color, fluctuations arise in minimum emission voltage. For example, the minimum emission voltage fluctuates in a range of 1.75V to 2.45V in the red LED, while fluctuating in a range of 2.9V to 3.9V in the green LED and blue LED. The fluctuations in minimum emission voltage are due to fluctuations in individual product caused by LED manufacturing.

In this embodiment, not only setting applied voltages for the red LED lower than applied voltages for the green and blue LEDs, applied voltages in consideration of fluctuations in minimum emission voltage among individual products are stored in the registers 11, 12 and 13 for respective colors. It is thereby possible to obtain a desired luminance of the LED of each color while reducing power consumption. Applied voltage values are stored in the registers 11, 12 and 13 for respective colors via storage value setting bus 14, as described later.

Referring to FIG. 1 again, a configuration of LED driving device 10 will be described below. LED driving device 10 has R duty ratio storage register 21, G duty ratio storage register 22 and B duty ratio storage register 23. Each of the registers 21, 22 and 23 stores duty ratio data of PWM signal to perform PWM control on the LED of each color, R, G, or B, respectively. Each of the registers 21, 22 and 23 is connected to storage value setting bus 14, and the duty ratio data for the LED of each color is stored in each of the registers 21, 22 and 23 via storage value setting bus 14 when the product of LED driving device 10 is shipped.

The duty ratio data for the LED of each color output from each of the registers 21, 22 and 23 is output to PWM waveform forming circuit 24, 25 or 26, respectively. Each of PWM waveform forming circuits 24, 25 and 26 forms a PWM waveform corresponding to the duty ratio data in synchronization with a clock signal CLK.

PWM waveform forming circuit 24, 25 or 26 outputs a PWM waveform to the base of transistor 27, 28 or 29 based on the red-LED emission timing signal TR, green-LED emission timing signal TG, or blue-LED emission timing signal TB, respectively. In each transistor 27, 28 or 29, the collector is connected to an output terminal of the LED of R, G or B, while the emitter is grounded, respectively.

By this means, during an emission period of the red LED, only the red-LED emission timing signal TR has a logic value of "1", a PWM signal is only output from PWM waveform forming circuit 24 provided for the red LED, the current corresponding to the PWM signal flows into the red LED, and the red LED emits light. Similarly, during an emission period of the green LED, only the green-LED emission timing signal TG has a logic value of "1", a PWM signal is only output from PWM waveform forming circuit 25 provided for the green LED, the current corresponding to the PWM signal flows into the green LED, and the green LED emits light. During an emission period of the blue LED, only the blue-LED emission timing signal TB has a logic value of "1", a PWM signal is only output from PWM waveform forming circuit 26 provided for the blue LED, the current corresponding to the PWM signal flows into the blue LED, and the blue LED emits light.

Figure 3:
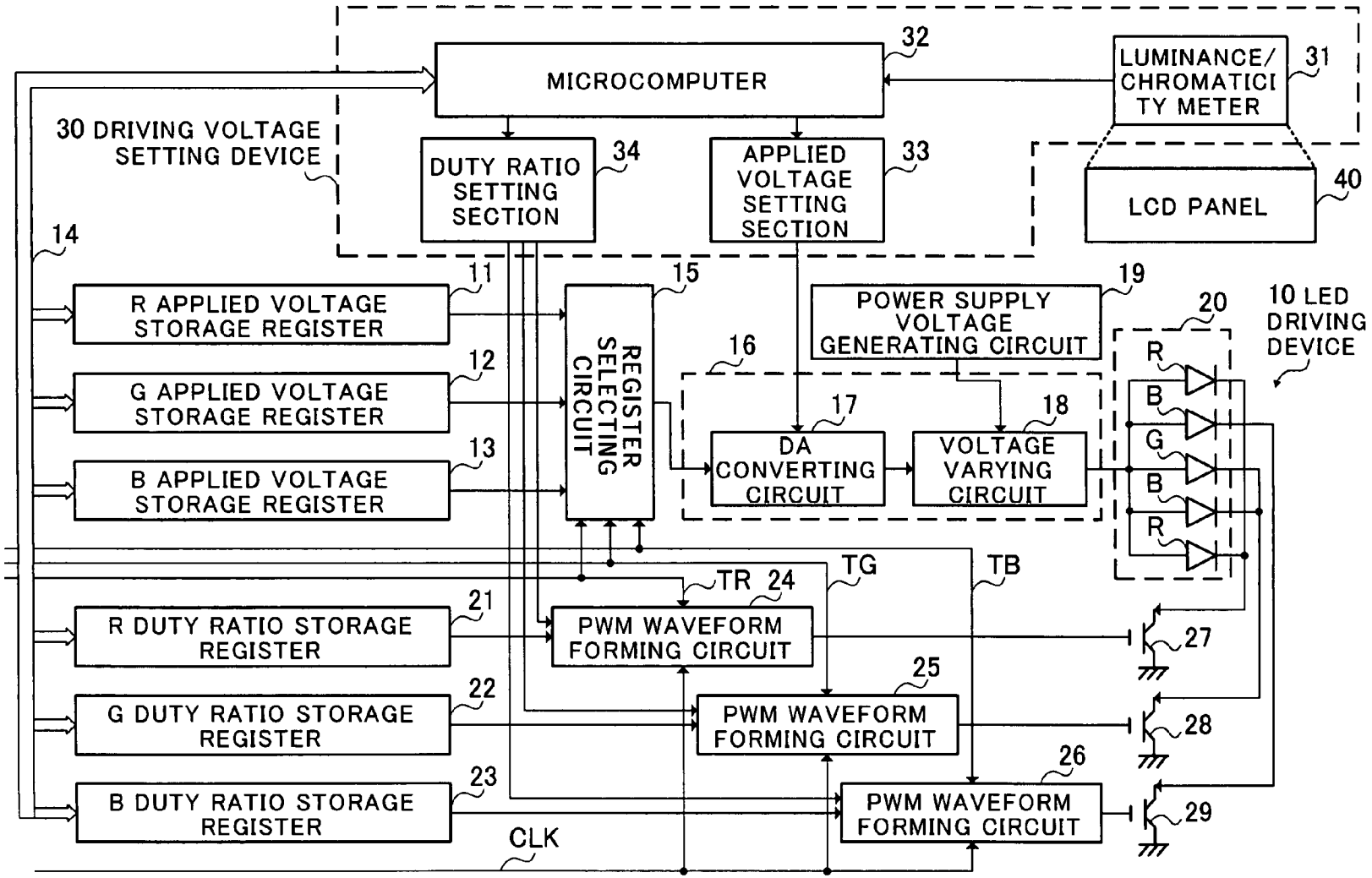
FIG. 3 is a block diagram illustrating a configuration of a driving voltage setting device according to the Embodiment.

FIG. 3 illustrates a configuration of driving voltage setting device 30 for setting voltage values to store in applied voltage storage registers 11, 12 and 13 for respective colors. In addition, driving voltage setting device 30 has the configuration capable of obtaining duty ratio data for the LED of each color to store in duty ratio storage register 21, 22 or 23, as well as voltage values for the LED of each color to store in applied voltage storage register 11, 12 or 13.

Driving voltage setting device 30 has luminance/chromaticity meter 31 to measure the luminance and chromaticity of transmission light from the LCD panel. In addition, the light emitted from LED unit 20 is incident on luminance/chromaticity meter 31 via a light guide plate (not shown) and LCD panel 40. The predetermined voltage is applied to the liquid crystal in each pixel position from an LCD driving circuit (not shown) at predetermined timing to drive the liquid crystal in open or close, whereby LCD panel 40 passes or shields the light emitted from the LED. In addition, it is assumed that LED unit 20, the light guide plate and LCD panel 40 are assembled in the same way as in shipment of the product.

The data of luminance and chromaticity obtained from luminance/chromaticity meter 31 is output to microcomputer 32. Driving voltage setting device 30 has applied voltage setting section 33 and duty ratio setting section 34, and a voltage value set in applied voltage setting section 33 is output to DA converting circuit 17 of LED driving device 10, while the duty ratio data set in duty ratio setting section 34 is output to PWM waveform forming circuits 24, 25 and 26. The set voltage value and set duty ratio are designated from microcomputer 32. In other words, the microcomputer recognizes the set voltage value and duty ratio.

Microcomputer 32 judges whether the luminance and chromaticity meet respective desired values beforehand set, and when the desired values are met, writes the voltage value applied at this point in applied voltage storage register 11, 12 or 13, and further writes the duty ratio in duty ratio storage register 21, 22 or 23, via storage value setting bus 14. In other words, microcomputer 32 has the function as means for writing storage data in applied voltage storage registers 11, 12 and 13 and in duty ratio storage registers 21, 22 and 23.

Figure 4:
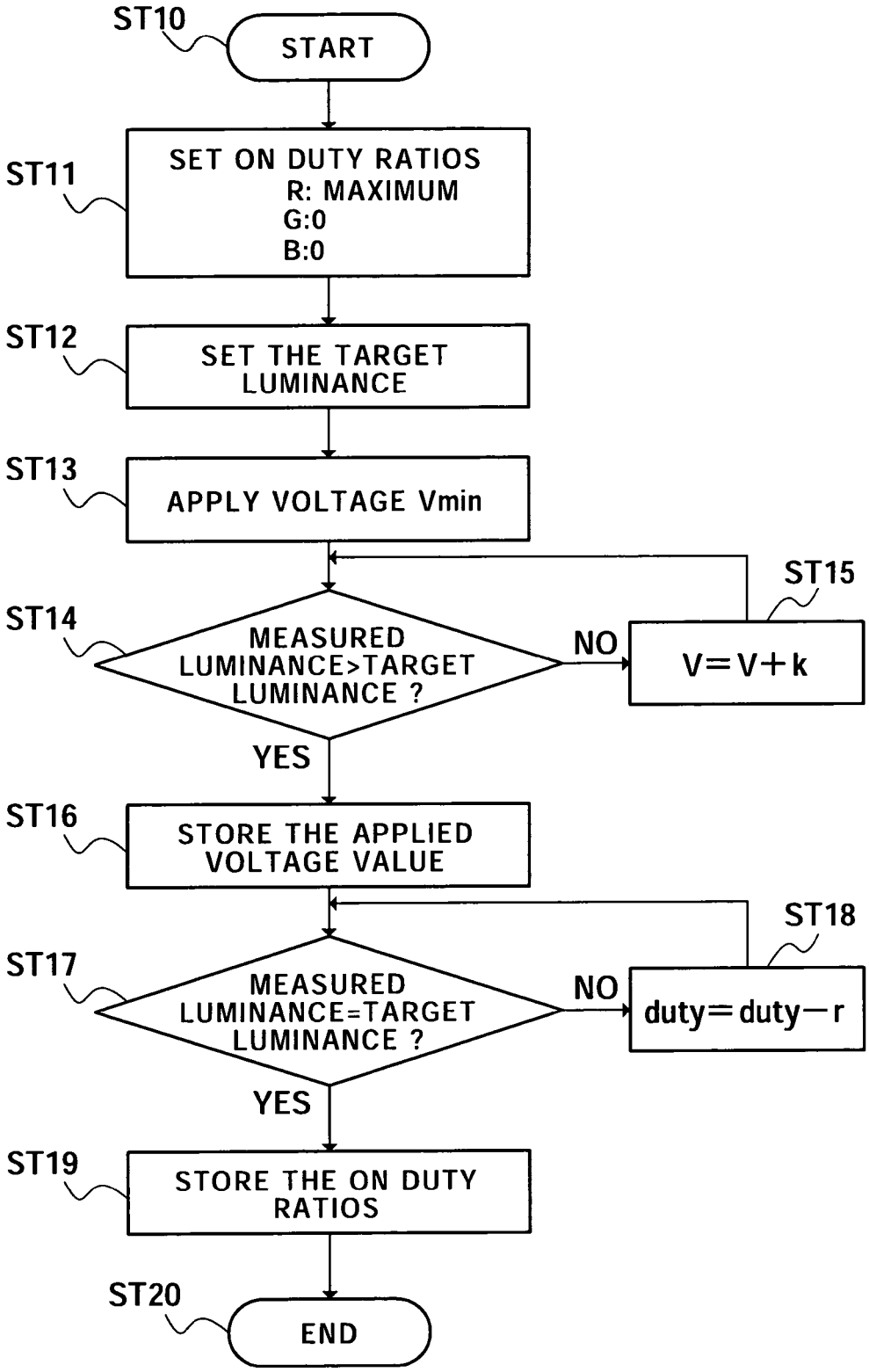
FIG. 4 is a flowchart to explain processing for setting an applied voltage and a duty ratio in the driving voltage setting device.

Referring to FIG. 4, processing will specifically be described below for driving voltage setting device 30 to record applied voltage values (minimum emission voltages) in applied voltage storage registers 11, 12 and 13 for respective colors and further record the duty ratio data in duty ratio storage registers 21, 22 and 23.

Driving voltage setting device 30 starts the processing in step ST10, and in the subsequent step, ST1, sets duty ratios in duty ratio setting section 34. Since the case of FIG. 4 shows processing for setting a voltage to apply to the red LED, the setting device 30 sets the ON duty ratio of the red LED at a maximum value, while setting ON duty ratios of the green and blue LEDs at zero. In other words, PWM waveform forming circuit 24 is given data with the ON duty ratio of the maximum value, while PWM waveform forming circuits 25 and 26 are given data with the ON duty ratio of "0". In step ST12, microcomputer 32 sets a target luminance.

In step ST13, applied voltage setting section 33 sets a minimum applied voltage value Vmin (for example, 1.5V), and voltage varying circuit 18 converts the voltage generated in power supply voltage generating circuit 19 into the set voltage to apply to LED unit 20. At this point, since only the red PWM waveform forming circuit 24 outputs a PWM signal with the maximum ON duty ratio, the red LED is only in a state for enabling light emission.

In step ST14, microcomputer 32 judges whether or not the measured luminance obtained by luminance/chromaticity meter 31 is greater than the target luminance. When the measured luminance is less than the target luminance, microcomputer 32 shifts to the processing of step S15, increases a set applied voltage in applied voltage setting section 33 by k (for example, 0.1V), and makes the judgment in step ST14 again.

A positive result obtained in step ST14 means that the minimum voltage required to obtain a desired luminance is currently being applied to the red LED, and the processing flow shifts to step ST16 where microcomputer 32 writes the voltage value currently set in applied voltage setting section 33 in R applied voltage storage register 11. Thus, the minimum emission voltage value required for the red LED to obtain a desired luminance is stored in R applied voltage storage register 11.

In the subsequent step, ST17, microcomputer 32 judges whether or not the measured luminance agrees with the target luminance. When agreement is not obtained, microcomputer 32 shifts to step ST18, decreases the ON duty ratio set in duty ratio setting section 32 by r, and returns to step ST17.

A positive result obtained in step ST17 means that it is possible to cause the red LED to emit light with the desired luminance using the PWM signal with the duty ratio currently set in duty ratio setting section 34, and the processing flow shifts to step ST19 where microcomputer 32 writes the duty ratio currently set in duty ratio setting section 34 in R duty ratio storage register 21. Thus, the duty ratio data for the red LED to obtain the desired luminance is stored in R duty ratio storage register 21.

In other words, the processing of steps ST17 to ST19 indicates that the duty ratio is set to perform fine luminance control using the PWM signal so as to bring the luminance close to the target luminance after setting in steps ST14 to ST16 the minimum applied voltage enabling the target luminance to be obtained. In the subsequent step, ST20, driving voltage setting device 30 finishes the processing for writing data in R applied voltage storage register 11 and R duty ratio storage register 21.

In addition, herein described is the processing for writing data in R applied voltage storage register 11 and R duty ratio storage register 21, and similar procedures are carried out to perform processing for writing data in G and B applied voltage storage registers 12 and 13 and G and B duty ratio storage registers 22 and 23.

Figure 5:
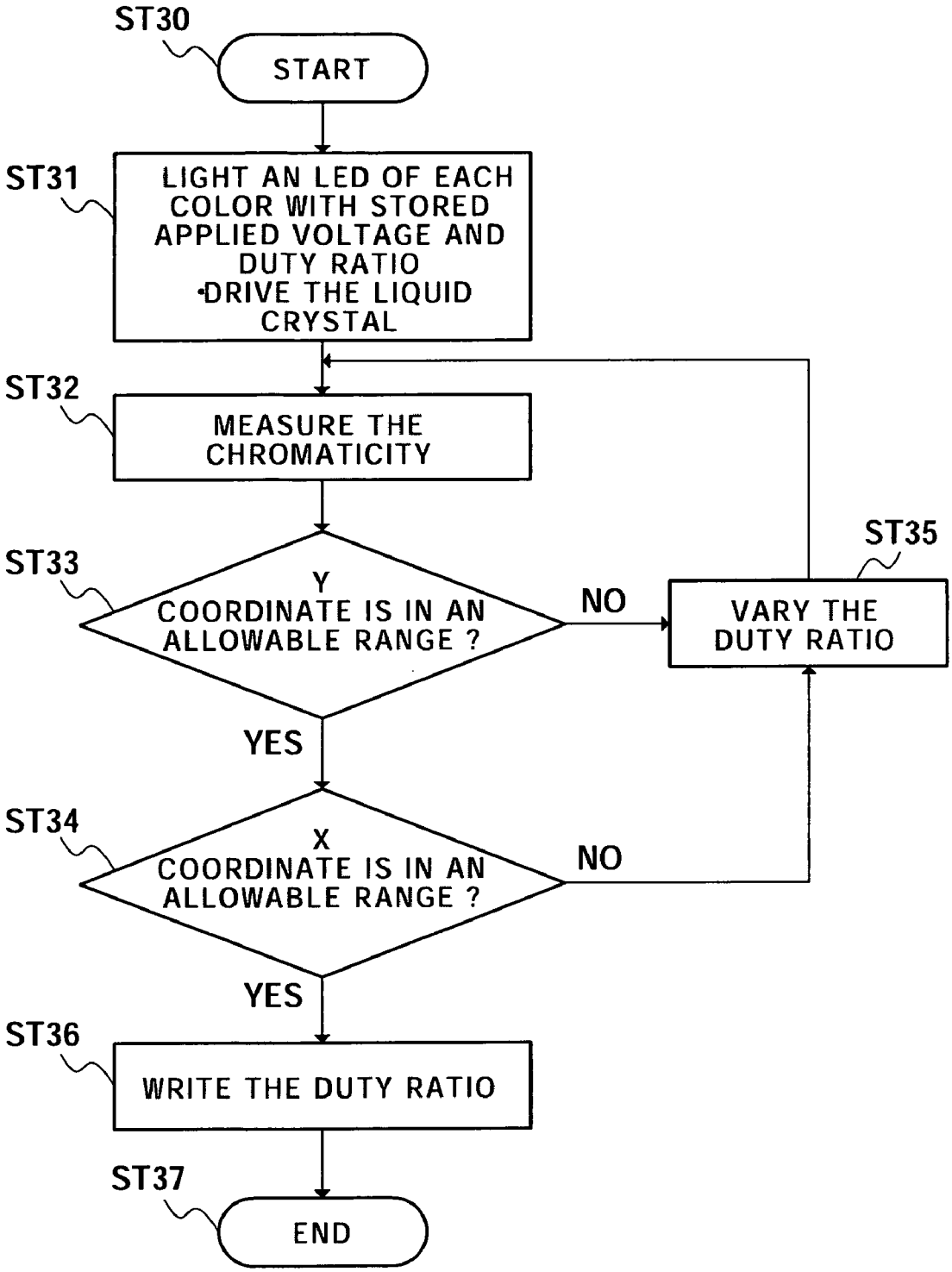
FIG. 5 is a flowchart to explain processing for setting a duty ratio to obtain the desired white balance.

Referring to FIG. 5, procedures will be described below to store in the registers 21, 22 and 23 duty ratios for respective colors to obtain the desired white balance.

Driving voltage setting device 30 starts white balance adjustment processing in step ST30, and in the subsequent step, ST31, lights the LEDs of respective colors sequentially using applied voltages stored in the applied voltage storage registers 11, 12 and 13 and PWM signals with duty ratios stored in the duty ratio storage registers 21, 22 and 23, while driving LCD panel 40 using the LCD driving circuit (not shown).

Actually, LED driving device 10 applies voltages for the LEDs of respective colors stored in the applied voltage storage registers 11, 12 and 13 sequentially to LED unit 20, and in synchronization with the voltage application, PWM waveform forming circuits 24, 25 and 26 form PWM signals for the LEDs of respective colors corresponding to the duty ratios stored in the duty ratio storage registers 21, 22 and 23.

In other words, in step ST31 is performed actual LED driving and LCD driving in the field sequential system. It is herein assumed that data stored in the applied voltage storage registers 11, 12 and 13 and the duty ratio storage registers 21, 22 and 23 is data set as shown in FIG. 4.

Figure 6:
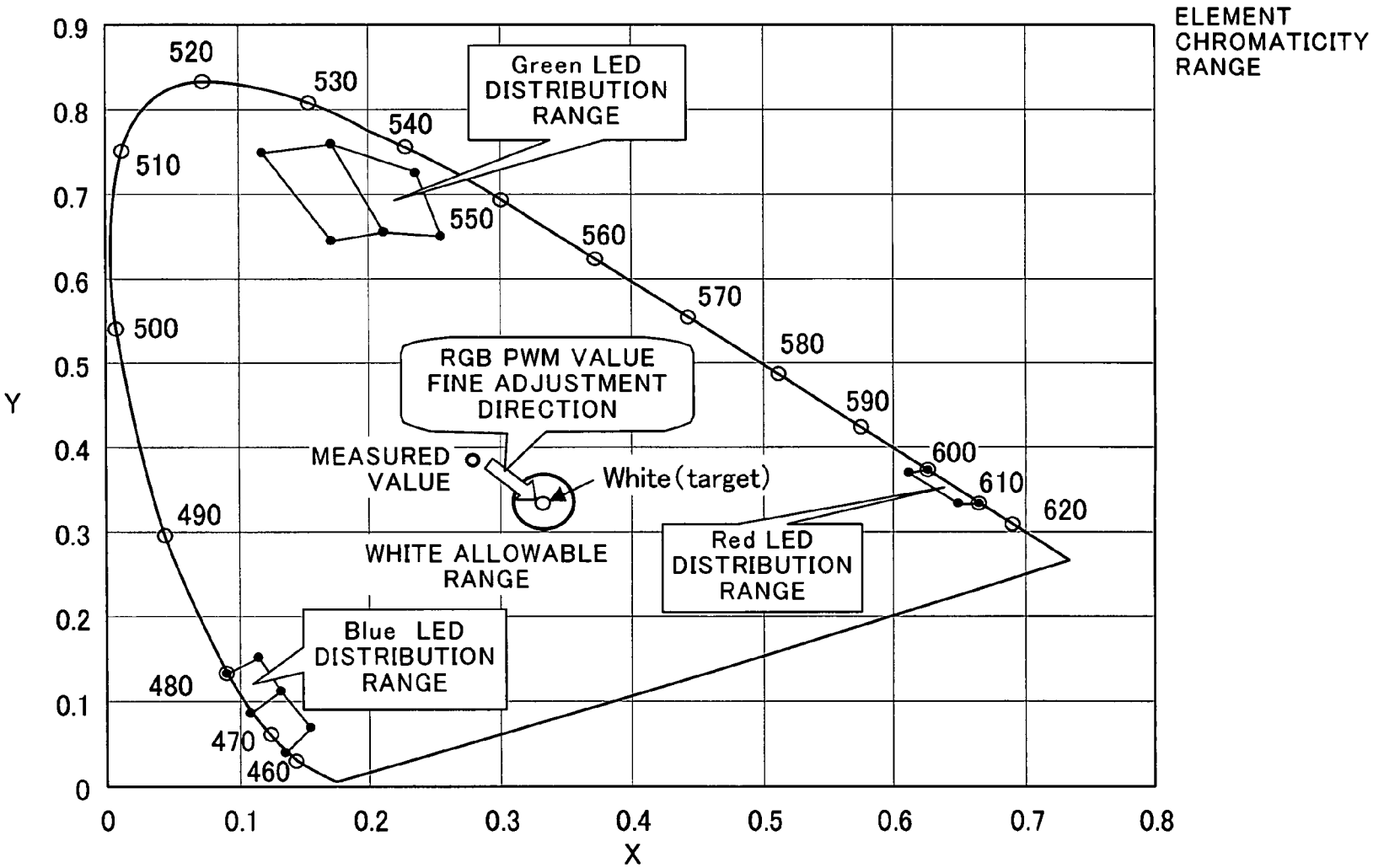
FIG. 6 is a chromaticity spatial diagram to explain the processing for setting a duty ratio to obtain the desired white balance.

In step S32, luminance/chromaticity meter 31 measures the chromaticity of a display color. FIG. 6 shows measured degrees of chromaticity plotted in the chromaticity space. Then, microcomputer 32 calculates a difference between the measured chromaticity and a target value of the white balance, and duty ratio setting section 34 changes duty ratios to set corresponding to the difference to supply to PWM waveform forming circuits 24, 25 and 26. Microcomputer 32 is capable of reading out duty ratios for respective colors stored in the duty ratio storage registers 21, 22 and 23, and based on the read duty ratios for respective colors and the difference between the measured chromaticity and target value of the white balance, designates the duty ratios for respective colors to next set in duty ratio setting section 34. By this means, the duty ratios for respective colors are set at values such that the target white balance is obtained.

Specifically, it is first judged in step ST33 whether or not the Y coordinate of the measured chromaticity is within a white allowable range as shown in FIG. 6, and it is further judged in step ST34 whether or not the X coordinate of the measured chromaticity is within the white allowable range as shown in FIG. 6. When a negative result is obtained in either step ST33 or step ST34, the processing flow shifts to step ST35, and duty ratio setting section 34 changes the duty ratio.

The change of duty ratio is performed in consideration of the difference in direction and amount between a target point of white balance and the measured value. In the case of this embodiment, microcomputer 32 prorates the direction and amount of the difference according to degrees of chromaticity of R, G and B, and thereby, sets a duty ratio for each color to next provide to LED driving device 10.

For example, as shown in FIG. 6, a case is considered where the Y coordinate of a measured value is larger than that of the target point, and that the X coordinate of the measured value is smaller than that of the target point. Respective distribution ranges of the LEDs of colors, R, G and B, in chromaticity space are generally as shown in FIG. 6. Therefore, in order to decrease the Y component and increase the X component to bring the white balance close to the target point, for example, the red ON duty ratio is increased, while the green ON duty ratio is decreased.

By thus setting ON duty ratios in proportional allocation as described below, it is possible to find respective duty ratios for the colors such that the target white balance is obtained a small number of settings.

Obtaining positive results in both steps ST33 and ST34 means that the white balance is in the white allowable range, and therefore, driving voltage setting device 30 shifts to step ST36, stores duty ratios for red, green and blue currently set in duty ratio setting section 34 respectively in the duty ratio storage registers 21, 22 and 23, and finishes the white balance adjustment processing in the subsequent step, ST37.

Thus, driving voltage setting device 30 starts with the duty ratio such that a desired luminance is obtained on the LED of each of colors, R, G and B, independently, measures the white balance of the actual display color, changes respective duty ratios for the colors corresponding to the measured values, while searching for duty ratios such that the desired white balance is obtained, and stores respective duty ratios for the colors at the time the desired white balance is obtained in corresponding duty ratio storage registers 21, 22 and 23.

In this way, driving voltage setting device 30 changes the duty ratio for each color, thereby makes an adjustment to the white balance, and therefore, is capable of adjusting the white balance finely with ease. Further, by storing duty ratios to adjust the white balance in the rewritable registers 21, 22 and 23, it is possible to write duty ratios specific to each product while actually measuring the chromaticity of the product. Therefore, even when there are fluctuations in LED, light guide plate and LCD panel for each product, it is possible to obtain the desired white balance in each product.

Figure 7:
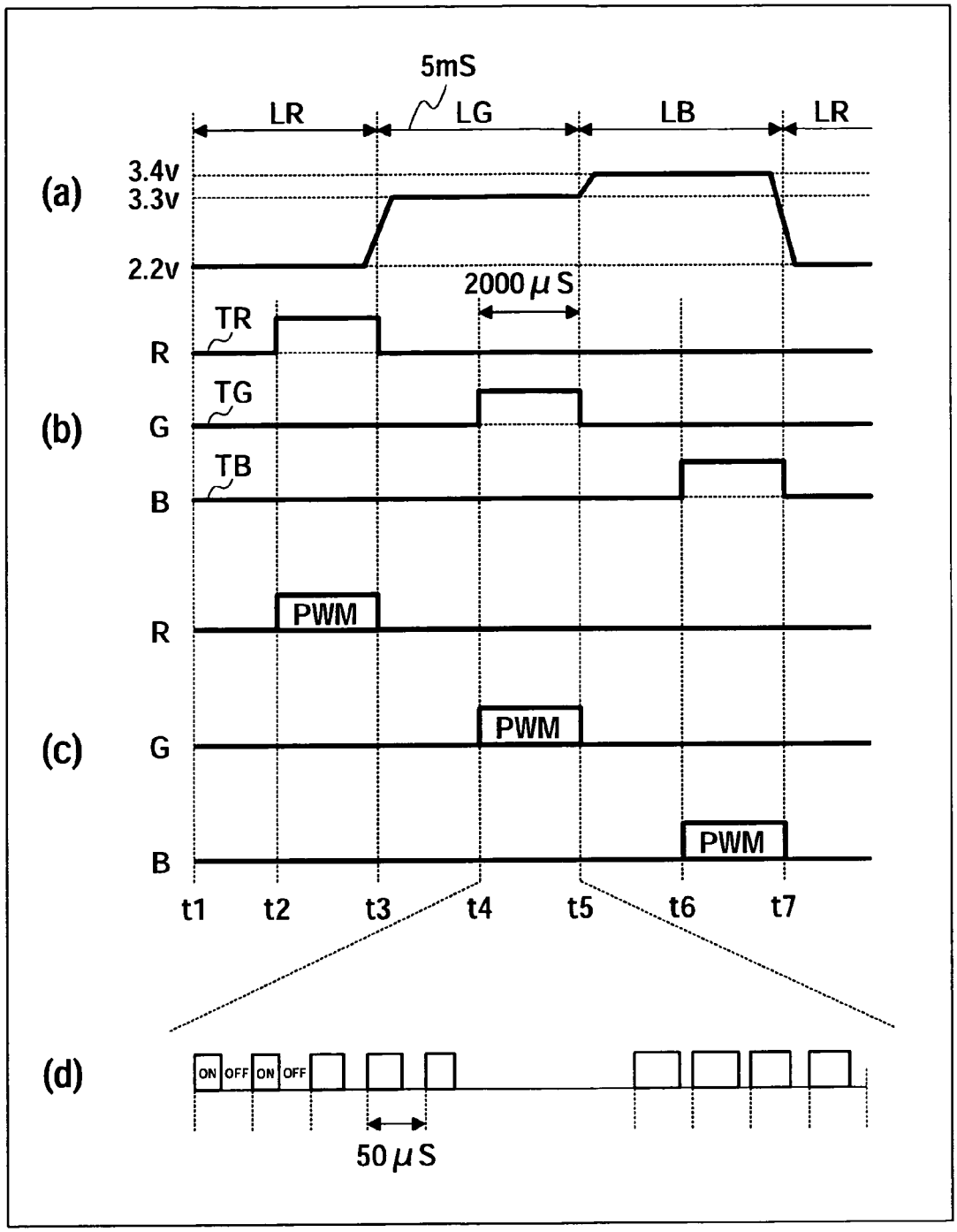
FIG. 7 is a waveform diagram to explain the operation of the LED driving device.

The operation of LED driving device 10 of this embodiment will be described below with reference to FIG. 7. In LED driving device 10, in an red-LED emission period LR, register selecting circuit 15 first selects an output of R applied voltage storage register 11 among from outputs of the applied voltage storage registers 11, 12 and 13, and voltage varying circuit 18 forms a voltage of 2.2V corresponding to the output of R applied voltage storage register 11, and supplies the voltage of 2.2V to LED unit 20 as shown in FIG. 7(*a*).

When the red-LED emission timing signal TR rises at time t2 during the red-LED emission period LR, PWM waveform forming circuit 24 outputs a PWM signal with the duty ratio stored in R duty ratio storage register 21 to transistor 27, and thereby the red LED emits light in the luminance corresponding to the PWM signal. Then, when the red-LED emission timing signal TR falls at time t3, the output from PWM waveform forming circuit 24 is halted, and register selecting circuit 15 selects an output of G applied voltage storage register 12, substituting for the output of R applied voltage storage register 11.

By this means, in a green-LED emission period LG, LED driving device 10 forms a voltage of 3.3V in voltage varying circuit 18 corresponding to data of G applied voltage storage register 12, and supplies the voltage of 3.3V to LED unit 20. When the green-LED emission timing signal TG rises at time t4 during the green-LED emission period LG, PWM waveform forming circuit 25 outputs a PWM signal with the duty ratio stored in G duty ratio storage register 22 to transistor 28, and thereby the green LED emits light in the luminance corresponding to the PWM signal. Then, when the green-LED emission timing signal TG falls at time t5, the output from PWM waveform forming circuit 25 is halted, and register selecting circuit 15 selects an output of B applied voltage storage register 13, substituting for the output of G applied voltage storage register 12.

By this means, in a blue-LED emission period LB, LED driving device 10 forms a voltage of 3.4V in voltage varying circuit 18 corresponding to data of B applied voltage storage register 13, and supplies the voltage of 3.4V to LED unit 20. When the blue-LED emission timing signal TB rises at time t6 during the blue-LED emission period LB, PWM waveform forming circuit 26 outputs a PWM signal with the duty ratio stored in B duty ratio storage register 23 to transistor 29, and thereby the blue LED emits light in the luminance corresponding to the PWM signal. Then, when the blue-LED emission timing signal TB falls at time t7, the output from PWM waveform forming circuit 26 is halted, and register selecting circuit 15 selects an output of R applied voltage storage register 11, substituting for the output of B applied voltage storage register 13.

Thereafter, in the same way as the foregoing, repeated are the red-LED emission period LR, green-LED emission period LG and blue-LED emission period LB, whereby color display is carried out in the field sequential system.

In addition, in the case of this embodiment, each of the LED emission periods LR, LG and LB is set at about 5 mS, and the PWM signal output period for each color is set at about 2000 μs. Further, a waveform of the PWM signal has a unit cycle of 50 μs, and the duty ratio in the unit cycle is stored in each of the duty ratio storage registers 21 to 23. In the case of this embodiment, duty ratios of eight bits (=256 different ratios) are stored in each of the duty ratio storage registers 21 to 23.

Thus, according to this embodiment, the driving voltage for the LED of each color is stored in the applied voltage storage register 11, 12 or 13, and the LED of each color is driven with independent driving voltage, whereby it is possible to achieve LED driving device 10 enabling reduced current consumption.

Further, the data in the applied voltage storage registers 11, 12 and 13 is rewritable via storage value setting bus 14. Therefore, even when there are fluctuations in minimum emission voltage (i.e. minimum applied voltage required to obtain the desired luminance) in actually mounted LEDs due to individual differences, by changing voltages to store in the applied voltage storage registers 11, 12 and 13 as appropriate corresponding to the fluctuations, it is possible to cope with the fluctuations. As a result, for example, even after completion of a product, it is possible to easily set a driving voltage independent of the LED of each color such that the luminance required for the product is obtained and that current consumption is suppressed.

Furthermore, by performing PWM control on the LED of each color, and storing a duty ratio for PWM control independently in the duty ratio storage register 21, 22 or 23, it is possible to control the luminance of the LED of each color independently using a PWM signal having the duty ratio independent for each color, and it is thus possible to perform a luminance adjustment of the LED of each color with higher sensitivity.

Moreover, voltage varying circuit 18 is provided and converts a voltage generated in a single power supply voltage generating circuit 19 into the driving voltage for the LED of each color, and the configuration is thus simplified as compared with the case where a plurality of power supply voltage generating circuits is provided to generate the driving voltages for the LED of each color.

Embodiment 2

Figure 8:
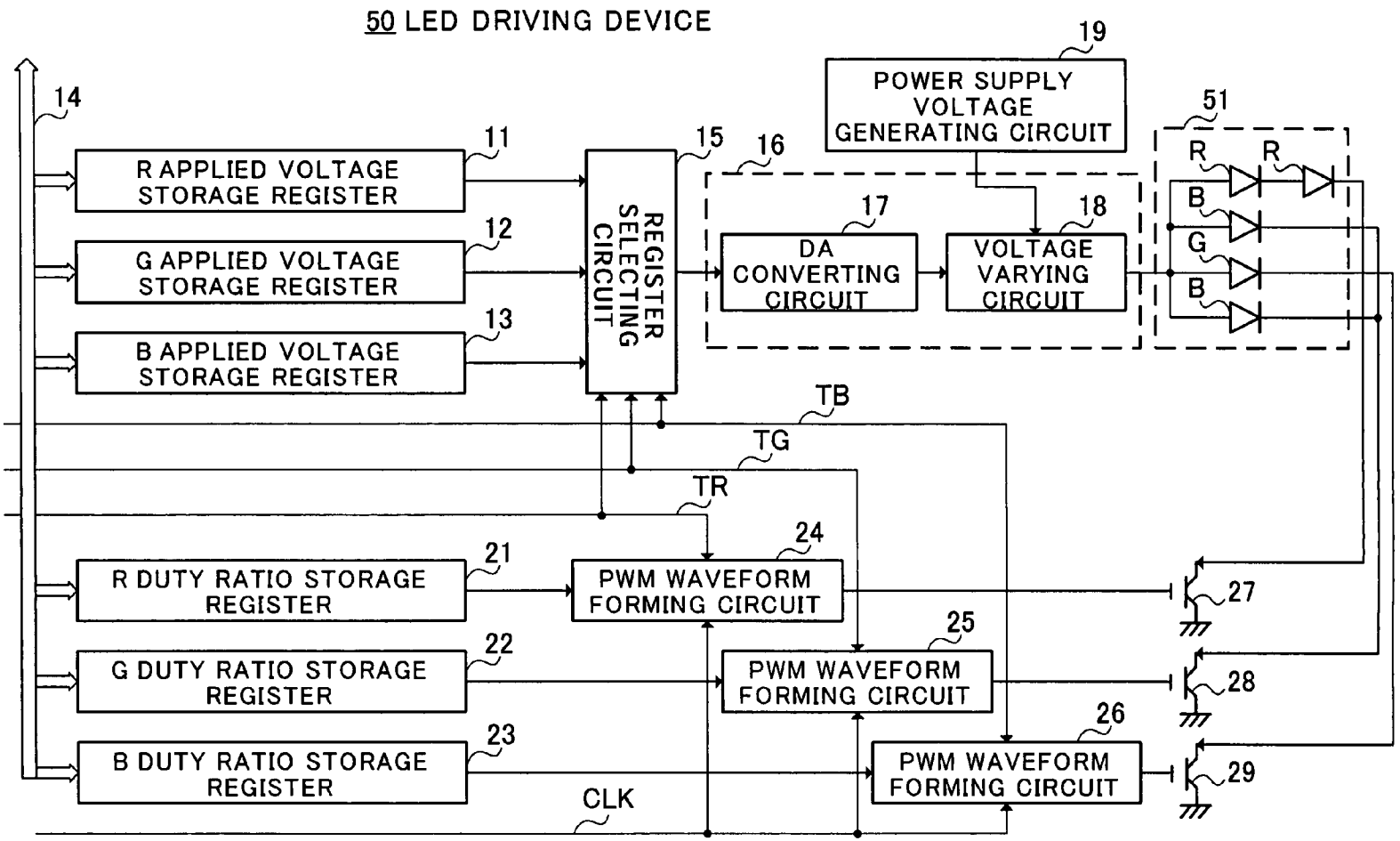
FIG. 8 is a block diagram illustrating a configuration of an LED driving device according to Embodiment 2.

FIG. 8 illustrates a configuration of LED driving device 50 according to Embodiment 2 of the present invention, where the same sections as in FIG. 1 are assigned the same reference numerals. LED driving device 50 has the same configuration as that of LED driving device 10 in Embodiment 1 except that connection of LEDs in LED unit 51.

In this Embodiment, red LEDs are in cascade connection among LEDs of red, green and blue. By this means, the number of power supply series to red LED is decreased, and it is thus possible to reduce current consumption required to light the red LEDs.

That is, in this Embodiment, attention is directed toward the fact that the driving voltage required to light the red LED in desired luminance is almost half the driving voltage required to light the green or blue LED in desired luminance.

Therefore, it is considered that two red LEDs in cascade connection are capable of emitting light with the voltage almost equal to the voltage to apply to the green or blue LED. In other words, by connecting the red LEDs in cascade arrangement as in this Embodiment, it is possible to reduce current consumption effectively without power supply voltage generating circuit 19 particularly generates high voltage.

Figure 9:
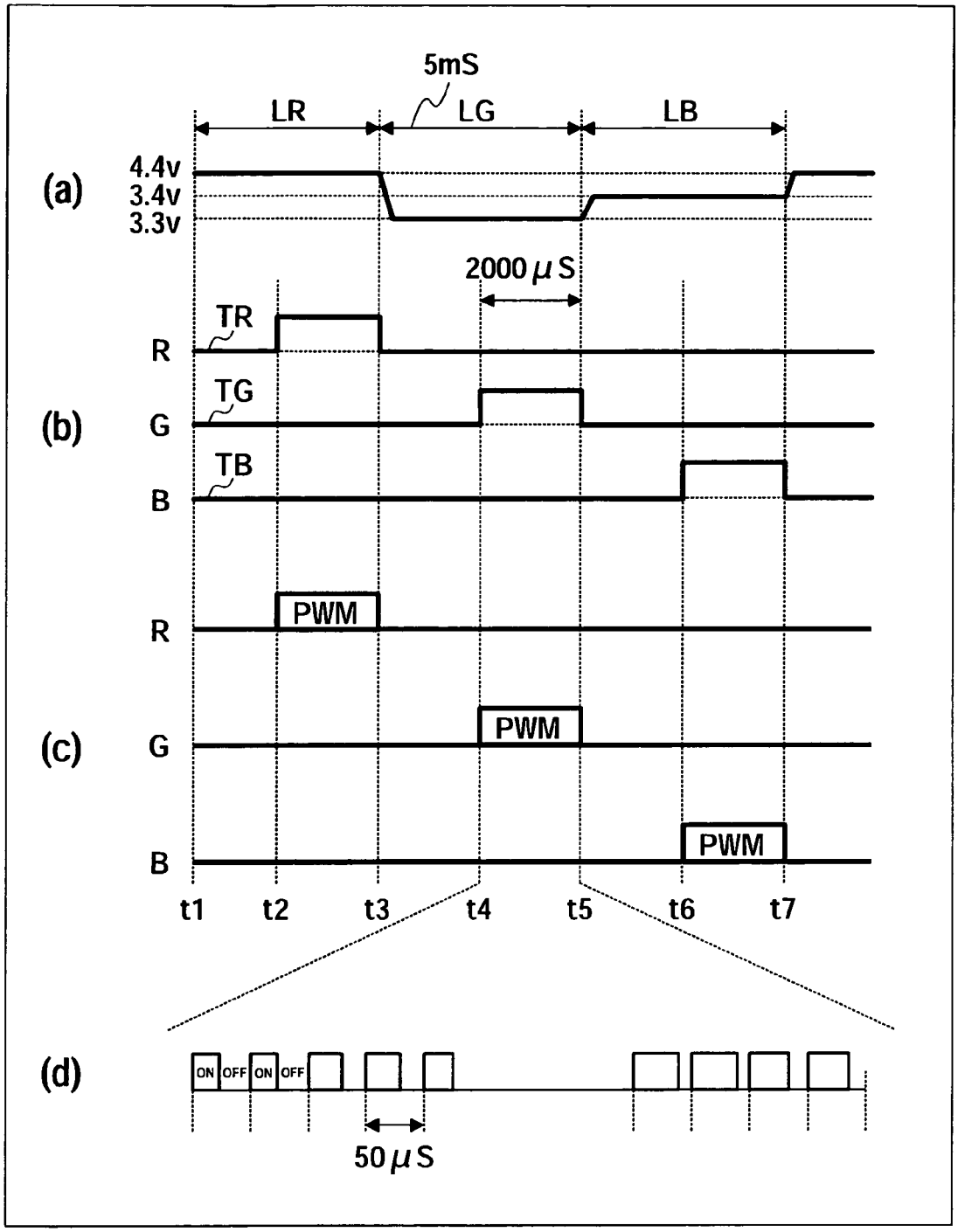
FIG. 9 is a waveform diagram to explain the operation of the LED driving device of Embodiment 2.

FIG. 9 illustrates the operation of LED driving device 50 of this Embodiment. FIG. 9 differs from FIG. 7 only in the voltage which substitutes 4.4V as shown in FIG. 9(*a*) for 2.2V. The voltage is to supply to LED unit 20 during the red LED emission period LR to light the red LEDs in cascade connection with the desired luminance. The voltage of 4.4V falls within a range of battery voltage in general portable electronic devices.

Thus, according to this Embodiment, by connecting the red LEDs in cascade arrangement among LEDs of red, green and blue, it is possible to implement LED driving device 50 enabling further reduced current consumption, in addition to the effects of Embodiment 1.

Other Embodiment

In addition, in the aforementioned embodiments, for simplicity in drawings and descriptions, each of LED units 20 and 51 is comprised of two red LEDs, two blue LEDs and one green LED, but the present invention is not limited to such the number of the LED of each color.

Further, any number is available as the number of LED units 20 or 51, and it may be possible to set the driving voltage and duty ratio of an LED of each color independently for each of the LED units to store in memory.

Moreover, it may be possible that a variable voltage is applied independently to each of LEDs of the same color, the luminance is detected independently on each of LEDs of the same color, a minimum applied voltage value when a luminance higher than a desired value is detected is set as a driving voltage value on each of LEDs of the same color and stored in the applied voltage storage register 11, 12 or 13, and that each of LEDs is driven with the voltage value. In this way, even when there are fluctuations in driving voltage required to obtain the desired luminance between LEDs of the same color, it is possible to drive each of the LEDs of the same color with the minimum driving voltage corresponding to the fluctuations, and thus, current consumption can further be reduced.

Similarly, it may be possible that each of LEDs of the same color is controlled using the PWM signal with a different duty ratio, the duty ratio for each of the LEDs of the same color when a desired luminance is detected is stored independently in the duty ratio storage register 21, 22 or 23, and that each of the LEDs undergoes PWM control using the duty ratio. In this way, even when there are fluctuations in duty ratio required to obtain the desired luminance between LEDs of the same color, each of the LEDs can be controlled in PWM using the duty ratio corresponding to the fluctuations, and it is thereby possible to make a finer luminance adjustment.

Further, the present invention is applicable to the case of driving each of white LEDs in a liquid crystal display device configured to perform color display in a combination of a plurality of white LEDs and color filter. In other words, a plurality of memory devices is provided respectively for the white LEDs to store minimum emission voltages and duty ratios corresponding to fluctuations in characteristics, and it is thereby possible to obtain the same effects as described in the above-mentioned Embodiments.

Furthermore, in the present invention, it may be possible to set values to store in the applied voltage storage registers 11 to 13 and duty ratio storage registers 21 to 23 corresponding to the arrangement of LEDs. In this way, it is possible to make a luminance adjustment corresponding to arranged positions of LEDs with ease. For example, in a liquid crystal display device in color filter system using a plurality of white LEDs as backlight, when there is a demand to make the luminance around circumference portions of the screen higher than the luminance around the center portion of the screen, by setting the applied voltage values and duty ratios of white LEDs corresponding to the circumference portions of the screen to be higher than the applied voltage values and duty rations of white LEDs corresponding to the center potion of the screen, it is possible to make a luminance arrangement corresponding to arranged positions of LEDs with ease.

Moreover, the above-mentioned embodiments describe the case of applying the LED driving device of the present invention to a liquid crystal display device in the field sequential system, but the LED driving device of the present invention is not limited to such a case, and is capable of being applied widely to display devices to perform color display using LEDs of three colors, R, G and B.

The present invention is not limited to the above-mentioned embodiments, and is capable of being carried into practice with various modifications thereof.

An aspect of an LED driving device of the present invention adopts a configuration provided with a power supply voltage generator, an applied voltage storage that stores therein an independent applied voltage value for an LED of each of colors, red, green and blue, provided in a display device, and an applied voltage former that converts a voltage generated in the power supply voltage generator into the applied voltage value stored in the applied voltage storage to apply to the LED of each of colors.

According to this configuration, based on voltage values stored in the applied voltage storage, the same driving voltage is applied to each LED of the same color, while the different voltage is applied to the LED of each color, and it is thereby possible to reduce current consumption as compared to the case of applying the same driving voltage to the LED of each color.

Another aspect of the LED driving device of the present invention adopts a configuration where the applied voltage storage is comprised of writable memory, and a signal line is connected to the memory to input an applied voltage value to store.

According to this configuration, it is possible to change an applied voltage value independent of the LED of each color to store in the applied voltage storage at any time. Therefore, even when there are fluctuations in minimum emission voltage (i.e. minimum applied voltage required to obtain the desired luminance) in actually mounted LEDs due to individual differences, by changing the voltage to store in the applied voltage storage as appropriate corresponding to the fluctuations, it is possible to cope with the fluctuations. As a result, for example, even after completion of a product, it is possible to easily set a driving voltage independent of the LED of each color such that the luminance required for the product is obtained and that current consumption is suppressed.

Another aspect of the LED driving device of the present invention adopts a configuration where the applied voltage storage stores independent applied voltage values for LEDs of the same color.

According to this configuration, even when there are fluctuations in driving voltage required to obtain the desired luminance between LEDs of the same color, it is possible to drive the LED with the minimum driving voltage corresponding to the fluctuations, and it is thus possible to further reduce current consumption.

Another aspect of the LED driving device of the present invention adopts a configuration provided with a duty ratio storage which is comprised of writable memory and stores therein, independently of an LED of each color, a duty ratio of a PWM signal to make a fine adjustment to luminance during an emission period of the LED of each color, a PWM controller which forms the PWM signal based on the duty ratio stored in the duty ratio storage independently of the LED of each color, and a signal line connected to the duty ratio storage to input the duty ratio to the duty ratio storage.

According to this configuration, it is possible to independently control the luminance of the LED of each color using the PWM signal having a duty ratio independent of each color, and it is thus possible to make a luminance adjustment of the LED of each color more delicately. Moreover, it is possible to change the duty ratio independent of each color to store in the duty ratio storage at any time, and therefore, even when there are fluctuations in luminance of the actually mounted LED or fluctuations in light guide plate or liquid crystal panel, it is made possible to write a duty ratio such that desired display luminance is obtained in the duty ratio storage as appropriate via the signal line corresponding to the fluctuations. Further, since it is possible to change the duty ratio independently of the LED of each color, the white balance can also be adjusted with ease.

Another aspect of the LED driving device of the present invention adopts a configuration where the applied voltage storage stores an applied voltage value for the LED of each color enabling the LED of each color to emit light in luminance more than or equal to a desired luminance, while the duty ratio storage stores a duty ratio for bringing an emission luminance of the LED of each color close to the desired luminance.

According to this configuration, it is possible to set the luminance of the LED of each color at a desired value while reducing current consumption.

Another aspect of the LED driving device of the present invention adopts a configuration where the duty ratio storage stores independent duty ratios on LEDs of the same color.

According to this configuration, even when there are fluctuations in duty ratio required to obtain the desired luminance between LEDs of the same color, since the duty ratio corresponding to the fluctuations is stored for each of the LEDs, it is possible to perform luminance display with higher definition.

Another aspect of the LED driving device of the present invention adopts a configuration where among LEDs of red, green and blue, red LEDs undergo cascade connection.

According to this configuration, it is possible to effectively generate the driving voltage for the red LED low in minimum emission voltage, and it is thus possible to reduce current consumption required to light the red LEDs. Herein, the inventor of the present invention noticed that the driving voltage required to light the red LED in desired luminance is almost half the driving voltage required to light the green or blue LED in desired luminance, and considered that two red LEDs in cascade connection emit light with the voltage almost equal to the voltage to apply to the green or blue LED. In other words, according to the above-mentioned configuration, current consumption is reduced without the power supply voltage generator generates extra voltage.

Another aspect of the LED driving device of the present invention adopts a configuration where the power supply voltage generator generates a single voltage value, and the applied voltage former has a D/A converter that performs digital/analog conversion on a voltage value stored in the applied voltage storage, and a voltage varying section that converts the single voltage generated in the power supply voltage generator into a voltage of an analog value converted in the D/A converter.

According to this configuration, it is possible to form an applied voltage independent of the LED of each color stored in the applied voltage storage from the voltage generated in the power supply voltage generator common to the LED of each color, and it is thus possible to simplify the configuration as compared to the case of providing power supply voltage generators corresponding to the LED of each color.

An aspect of a driving voltage setting device of the present invention adopts a configuration provided with a voltage applier that applies a variable voltage to an LED of each of colors, red, green and blue, a detector that detects a luminance of the LED of each of colors when the voltage applier applies the voltage, and a data writer that writes in memory a minimum applied voltage value of the LED of each of colors when the detector detects the luminance more than or equal to a desired value on the LED of each of colors, as a driving voltage value of the LED of each of colors.

According to this configuration, it is possible to set, independently of each color, the minimum driving voltage to the LED of each color such that the LED of each color emits light in luminance not less than the desired value.

In an aspect of an LED driving method of the present invention, a minimum driving voltage such that a desired luminance is obtained is measured in advance for an LED of each of colors, red, green and blue, the driving voltage is stored in an applied voltage storage for the LED of each of colors, and a voltage of the stored value is applied to the LED of each of colors.

According to this method, an independent driving voltage is applied to the LED of each of colors based on the voltage value stored in the applied voltage storage, and it is thus possible to reduce current consumption as compared to the case of applying the same driving voltage to the LED of each of colors.

In another aspect of the LED driving method of the present invention, PWM control is performed on the LED of each of colors using a PWM signal with a duty ratio varying with the LED of each of colors in such a state that the minimum driving voltage is applied to the LED of each of colors.

According to this method, it is possible to make a luminance adjustment of the LED of each of colors with sensitivity.

As described above, according to the present invention, when performing color display while driving LEDs of three colors, red, green and blue, current consumption can effectively be reduced. Further, it is possible to perform display with uniformity while absorbing fluctuations in characteristics of each LED.

This application is based on the Japanese Patent Applications No.2003-98486, No.2003-98487, and No.2003-98489 filed on Apr. 1, 2003, entire contents of which are expressly incorporated by reference herein.

INDUSTRIAL APPLICABILITY

The present invention is suitable for being applied to, for example, a liquid crystal display device.

The invention claimed is:

1. An LED driving device comprising:

a power supply voltage generator; an applied voltage storage that stores therein an applied voltage value on an each-color basis corresponding to a minimum emission voltage of an LED of each of colors, red, green and blue, provided in a display device;

an applied voltage former that converts a voltage generated in the power supply voltage generator into the applied voltage value stored in the applied voltage storage to apply to the LED of each of colors;

a duty ratio storage which is comprised of writable memory and stores therein, independently of the LED of each of colors, a duty ratio of a PWM signal to make a fine adjustment to luminance during an emission period of the LED of each of colors;

a PWM controller which forms the PWM signal based on the duty ratio stored in the duty ratio storage independently for the LED of each of colors; and a signal line connected to the duty ratio storage to input the duty ratio to the duty ratio storage.

2. The LED driving device according to claim 1, wherein the applied voltage storage stores an applied voltage value for the LED of each of colors enabling the LED of each of colors to emit light in luminance more than or equal to a desired luminance, while the duty ratio storage stores a duty ratio for bringing an emission luminance of the LED of each of colors close to the desired luminance.

3. The LED driving device according to claim 1, wherein the duty ratio storage stores independent duty ratios on LEDs of the same color.

4. A driving voltage selling device that sets a driving voltage of the LED driving device, comprising:

a power supply voltage generator; an applied voltage storage that stores therein an applied voltage value on an each-color basis corresponding to a minimum emission voltage of an LED of each of colors, red, green and blue, provided in a display device;

an applied voltage former that converts a voltage generated in the power supply voltage generator into the applied voltage value stored in the applied voltage storage to apply to the LED of each of said colors;

a voltage applier that applies a variable voltage to the LED of each of said colors;

a detector that detects a luminance of the LED of each of colors when the voltage applier applies the voltage; and a data writer that writes in the applied voltage storage a minimum applied voltage value of the LED of each of colors when the detector detects the luminance more than or equal to a desired value on the LED of each of colors, as an applied voltage value of the LED of each of said colors.

5. The driving voltage selling device according to claim 4, further comprising:

a PWM controller that controls the LED of each of colors, red, green and blue, using a PWM signal with a different duty ratio, wherein the data writer writes in memory a duty ratio on the LED of each of colors when the detector detects a desired luminance on the LED of each of colors.

6. The driving voltage setting device according to claim 4, wherein the voltage applier applies a variable voltage interpedently to each of LEDs of the same color, the detector detects a luminance independently on each of the LEDs of the same color, and the data writer writes a minimum applied voltage value of each of the LEDs of the same color when a luminance more than or equal to a desired value is detected on the each of the LEDs of the same color in the applied voltage storage independently as the applied voltage value.

7. The driving voltage setting device according to claim 5, wherein the PWM controller controls each of the LEDs of the same color using a PWM signal with a different duty ratio, and the data writer writes in the memory a duty ratio on each of the LEDs of the same color when a desired luminance is detected on the each of the LEDs of the same color.

* * * * *